US009227413B2

(12) United States Patent
Tsujino et al.

(10) Patent No.: US 9,227,413 B2
(45) Date of Patent: Jan. 5, 2016

(54) WASTE INK ABSORBER, WASTE INK TANK, LIQUID DROPLET EJECTING DEVICE

(71) Applicant: SEIKO EPSON CORPORATION, Tokyo (JP)

(72) Inventors: Kiyoshi Tsujino, Nagano (JP); Hidehiro Takano, Nagano (JP); Shunichi Seki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/132,666

(22) Filed: Dec. 18, 2013

(65) Prior Publication Data

US 2014/0184693 A1 Jul. 3, 2014

(30) Foreign Application Priority Data

Dec. 27, 2012 (JP) ..... 2012-284517
Dec. 27, 2012 (JP) ..... 2012-284518

(51) Int. Cl.
*B41J 2/165* (2006.01)
*B41J 2/17* (2006.01)
*B41J 2/185* (2006.01)

(52) U.S. Cl.
CPC ..... *B41J 2/1721* (2013.01); *B41J 2002/1856* (2013.01)

(58) Field of Classification Search
CPC ..... B41J 2/1721; B41J 2/165
USPC ..... 347/31, 36
See application file for complete search history.

(56) References Cited

U.S. PATENT DOCUMENTS

| | | | | |
|---|---|---|---|---|
| 4,469,734 | A | 9/1984 | Minto et al. | |
| 8,322,820 | B2 | 12/2012 | Hizawa | |
| 2004/0090503 | A1 * | 5/2004 | Kotaki et al. | 347/86 |
| 2006/0017770 | A1 * | 1/2006 | Harada et al. | 347/36 |
| 2009/0219339 | A1 * | 9/2009 | Harada | 347/36 |
| 2011/0025756 | A1 | 2/2011 | Tsuyama | |
| 2011/0080445 | A1 * | 4/2011 | Shimizu et al. | 347/31 |

FOREIGN PATENT DOCUMENTS

| | | | |
|---|---|---|---|
| JP | 3142589 | U | 6/2008 |
| JP | 2011-031427 | A | 2/2011 |
| JP | 2011-167960 | A | 9/2011 |
| JP | 2012-091408 | A | 5/2012 |

* cited by examiner

*Primary Examiner* — Jason Uhlenhake
(74) *Attorney, Agent, or Firm* — Global IP Counselors LLP

(57) ABSTRACT

To provide a waste ink absorber excellent in permeability and retaining performance, a waste ink absorber to be mounted in a waste ink tank to absorb waste ink discharged from a head for ejecting ink, includes, in a state of a single piece of the waste ink absorber not mounted in the waste ink tank, a portion low in density and a portion higher in density as compared with the portion low in density in a direction along a plane surface having a largest surface area.

8 Claims, 9 Drawing Sheets

WASTE INK ABSORBER, WASTE INK TANK, LIQUID DROPLET EJECTING DEVICE

CROSS-REFERENCE TO RELATED APPLICATIONS

This application claims priority to Japanese Patent Application No. 2012-284517 filed on Dec. 27, 2012 and Japanese Patent Application No. 2012-284518 filed on Dec. 27, 2012. The entire disclosure of Japanese Patent Application Nos. 2012-284517 and 2012-284518 is hereby incorporated herein by reference.

BACKGROUND

1. Technical Field

The present invention relates to a waste ink absorber, a waste ink tank, and a liquid droplet ejecting device.

2. Background Technology

A liquid ejecting device is known in which a waste liquid receptacle into which liquid discharged from an injection head flows and a waste liquid absorbing material for absorbing the liquid flowed into the waste liquid receptacle are provided (see, e.g., Patent Document 1).

Japanese Laid-open Patent Publication No. 2011-167960 (Patent Document 1) is an example of the related art.

SUMMARY

Problems to Be Solved by the Invention

However, the density of the waste liquid absorbing material mounted in the aforementioned device is approximately uniform, and therefore there are problems that, in cases where the permeability of the waste liquid with respect to the waste liquid absorbing material is relatively good, the retention performance for retaining the absorbed waste liquid deteriorates, while in cases where the retention performance of the absorbed waste liquid with respect to the waste liquid absorbing material is relatively good, the permeability for absorbing the waste liquid deteriorates.

Means Used to Solve the Above-Mentioned Problems

The invention was made to solve at least a part of the aforementioned problems, and is capable of realizing the following embodiments or applied examples.

Application Example 1

A waste ink absorber according to this applied example is a waste ink absorber to be mounted in a waste ink tank to absorb waste ink discharged from a head for ejecting ink, wherein, in a state of a single piece of the waste ink absorber not mounted in the waste ink tank, the waste ink absorber includes a first density portion and a second density portion in a direction along a plane surface having a largest surface area, and wherein the second density portion is higher in density than the first density portion.

According to this structure, in the first density portion lower in density than the second density portion, the waste ink can be easily impregnated. Further, in the second density portion higher in density than the first density portion, the waste ink impregnated can be retained. Accordingly, a waste ink absorber excellent in permeability and retention performance can be provided. The waste ink denotes, for example, ink which was discharged from a head but not reached a medium. Specifically, the waste ink denotes ink generated by flushing for ejecting ink for the purpose of preventing increasing of ink viscosity, etc., or cleaning for forcibly discharging ink with a pump, etc., for the purpose of recovering of a nozzle which became unable to inject ink by increased ink viscosity or destruction of meniscuses, influence of paper powder, etc., or preventing increasing of the ink viscosity. Further, in the so-called borderless printing, since ink deviated from a medium is also ink which has not reached the medium, it is included in waste ink.

Application Example 2

The waste ink absorber according to the aforementioned applied example is characterized in that, in a state in which the waste ink absorber is not mounted in the waste ink tank, a thickness of the waste ink absorber is constant.

With this structure, since the thickness is constant, a plurality of waste ink absorbers can be easily piled up. And, for example, mounting into a waste ink tank can be easily performed.

Application Example 3

The waste ink absorber according to the aforementioned applied example is characterized in that the waste ink absorber has the second density portion around a void and the first density portion around the second density portion.

With this structure, it becomes possible to impregnate waste ink from the void with the highest efficiency. Further, in the second density portion, the impregnated waste ink can be retained. Further, in the first density portion, waste ink which cannot be retained by the second density portion can be absorbed to impregnate the waste ink by the entire waste ink absorber. Accordingly, a waste ink absorber excellent in permeability and retention performance can be provided.

Application Example 4

A waste ink absorber according to the aforementioned applied example is characterized in that a volume of the second density portion is smaller than a volume of the first density portion.

With this structure, it is possible to efficiently impregnate waste ink from the second density portion to first density portion.

Application Example 5

The waste ink absorber according to the aforementioned applied example is characterized in that a total average density of the void, the second density portion and the first density portion is the same as the first density portion.

With this structure, high/low density can be formed easily.

Application Example 6

A waste ink tank according to this applied example is characterized in that the waste ink tank is provided with the aforementioned waste ink absorber and a container portion for contain the waste ink absorber.

With this structure, by containing the waste ink absorber having waste ink permeability and retention property, for example, even in cases where the waste ink tank is arranged obliquely or sideways, the absorbed waste ink can be retained to prevent leakage, etc.

Application Example 7

A liquid droplet ejecting device according to this applied example is characterized in that the liquid droplet ejecting device is equipped with a head for ejecting ink, and the aforementioned waste ink tank for capturing the waste ink discharged from the head.

With this structure, it becomes possible to provide a highly-reliable liquid droplet ejecting device capable of absorbing waste ink efficiently without causing defects such as ink leakage, etc.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, first and second embodiments of the invention will be explained with reference to drawings. In each of the following drawings, the measurement of each member, etc., is shown to be different from the actual measurement in order to attain recognizable size of each member, etc.

First Embodiment

Figure 1:
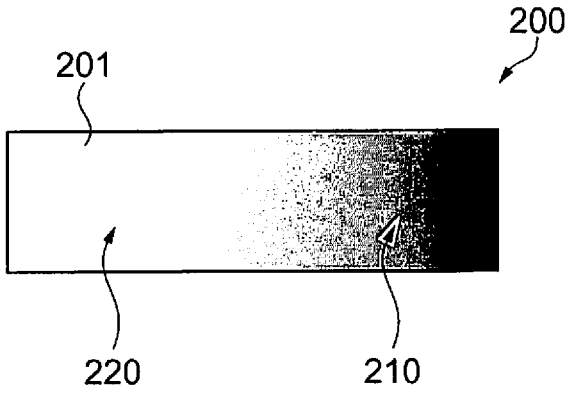
FIG. 1 is a pattern diagram showing a structure of a waste ink absorber according to a first embodiment.

Initially, the structure of the waste ink absorber will be explained. FIG. 1 is a pattern diagram showing a structure of a waste ink absorber according to a first embodiment. A rectangular waste ink absorber 200 is configured to absorb waste ink discharged from a head for ejecting ink and, for example, is to be mounted in a waste ink tank. As shown in FIG. 1, in a state of a single piece of a waste ink absorber 200 not mounted in a waste ink tank, the waste ink absorber includes a portion 220 low in density (first density portion) and a portion 210 high in density (second density portion) higher in density as compared with the low density portion 220 in a direction of a plane surface 201 having a largest surface area. In this embodiment, the high density portion 210 is formed at one portion of the plain surface 201 in a longitudinal direction and the low density portion 220 is formed at the other portion. In a state of not being mounted in the waste ink tank, in other words, in a state of not being deformed by compressing the waste ink absorber 200, the thickness of the waste ink absorber 200 is constant.

In the waste ink absorber 200 formed as mentioned above, at the portion 220 low in density, waste ink can be easily impregnated, and at the portion 210 high in density, absorbed waste ink can be retained.

The waste ink absorber 200 is constituted by a mixture including cellulose fibers, thermoplastic resin and flame retardant. The cellulose fibers are obtained by fibrillating a pulp sheet, etc., using, for example, a dry type fibrillation machine such as a rotary crushing apparatus, etc. The thermoplastic resin contributes to bonding of cellulose fibers, retention of appropriate strength (hardness, etc.) of the waste ink absorber 200, prevention of scattering of paper powder/fibers, and maintaining of the shape at the time of absorbing waste ink. The thermoplastic resin allows adaption of any configurations such as a fiber form or a powder form. By heating the mixture in which the cellulose fibers and the thermoplastic resin are mixed, the thermoplastic resin can be thermoplastic, the cellulose fibers are bonded each other. It is preferable that the welding is performed at a temperature not causing thermal deterioration of the cellulose fibers, etc. The thermoplastic resin is preferably a fibrous resin which is easily tangled with paper fibers in the fibrillated fabric. Further, it is preferable to be a composite fiber of a core-in-sheath structure. In the thermoplastic resin of the core-in-sheath structure, the peripheral sheath portion melts at a low temperature, and the fibrous core portion is bonded to the thermoplastic resin itself or the cellulose fiber, resulting in a strong juncture.

The flame retardant is added to give flame retardant properties to the waste ink absorber 200. As flame retardant, for example, inorganic materials such as aluminum hydrate, magnesium hydrate, etc. or phosphorous organic materials (for example, such as aromatic ester phosphate such as triphenylphosphate) can be used.

As a method of forming the waste ink absorber 200, for example, a mixture in which cellulose fibers, thermoplastic resin and flame retardant are mixed is screened to accumulate on a mesh belt arranged below the screen so as to form a predetermined shape to thereby form a deposited material. Then, the formed deposited material is subjected to a pressurization and heating treatment. With this, the thermoplastic resin is fused to obtain a predetermined thickness. By subjecting it to die cutting into a desired size, a waste ink absorber 200 is formed.

Figure 2A:
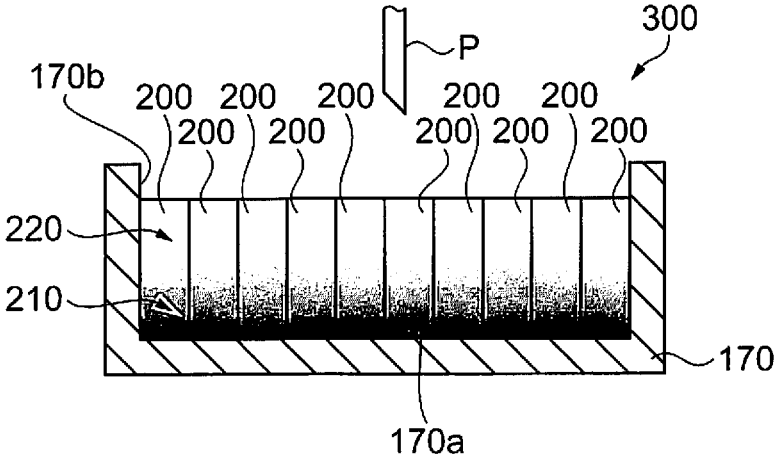
FIGS. 2A and 2B are schematic views showing a structure of a waste ink tank according to the first embodiment.
Figure 2B:
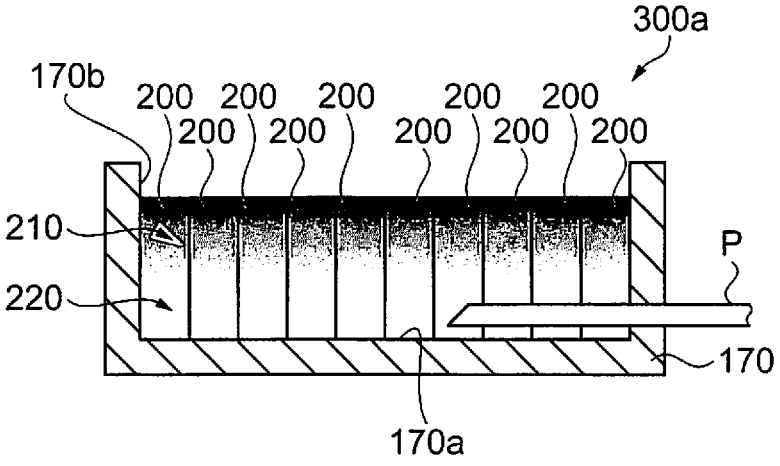

Next, the structure of the waste ink tank will be explained. FIGS. 2A and 2B show the structure of the waste ink tank according to the first embodiment, and FIG. 2A is a cross-sectional view. As shown in FIG. 2A, the waste ink tank 300 is equipped with a waste ink absorber 200 for absorbing waste ink and an container portion 170 for containing the waste ink absorber 200.

The container portion 170 for containing the waste ink absorber 200 is formed into, for example, a rectangular shape by plastic material. The container portion 170 includes a bottom surface portion 170*a* and a side surface portion 170*b*, and is formed so as to be able to accommodate and retain the waste ink absorber 200.

The structure of the waste ink absorber 200 is the same as the structure shown in FIG. 1, and therefore the explanation will be omitted. In this embodiment, a plurality of waste ink absorbers 200 are arranged in contact with each other. In FIG. 2A, the waste ink absorbers are arranged so that the high density portion 210 comes into contact with the bottom surface portion 170*a* side. In this case, it is preferable that the discharge spout of a pipe P for discharging waste ink is arranged at the position facing the low density portion 220.

When waste ink is discharged toward the waste ink absorber 200 via the pipe P, the waste ink comes into contact with the low density portion 220 of the waste ink absorber 200 and impregnated into the waste ink absorber 200. The absorbed waste ink is retained by the high density portion 210.

Next, a structure of another waste ink tank will be explained. FIG. 2B is a cross-sectional view showing the structure of another waste ink tank 300*a*. The structure of the waste ink absorber 200 is the same as the structure shown in FIG. 1, and therefore the explanation will be omitted. In FIG. 2B, a plurality of waste ink absorbers 200 are arranged in contact with each other. The waste ink absorbers are arranged so that the low density portion 220 comes into contact with the bottom surface portion 170*a* side. In this case, it is preferable that the pipe P is inserted into the low density portion 220 so that the discharge spout of the pipe P through which waste ink is discharged is positioned at the low density portion 220. By employing such configuration, in the same manner as mentioned above, the discharged waste ink can be easily impregnated into the waste ink absorber 200 and the absorbed waste ink can be retained.

Second Embodiment

Next, a second embodiment will be explained.

Figure 3:
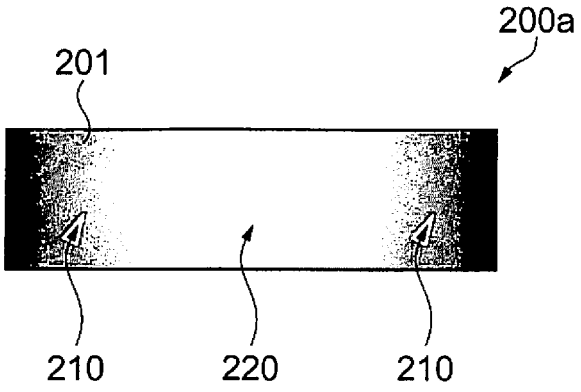
FIG. 3 is a pattern diagram showing a structure of a waste ink absorber according to a second embodiment.

First, the structure of the waste ink absorber will be explained. FIG. 3 shows a pattern diagram showing the structure of the waste ink absorber according to the second embodiment. The waste ink absorber 200*a* is configured to absorb waste ink discharged from a head for ejecting ink, and is to be mounted in, e.g., a waste ink tank. As shown in FIG. 3, in a single piece of a waste ink absorber 200*a* not mounted in a waste ink tank, the waste ink absorber includes, in a direction of the plain surface 201 having a largest surface area, a portion low in density (first density portion) 220 and a portion higher in density compared to the low density portion (second density portion) 210. In this embodiment, high density portions 210 are formed at both end portion sides in the longitudinal direction of the plain surface 201, and a low density portion 220 is formed at the central portion. In a state of not being mounted in a waste ink tank, the thickness of the waste ink absorber 200*a* is constant.

In the waste ink absorber 200*a* formed as mentioned above, at the portion 220 low in density, waste ink can be easily impregnated, and at the portion 210 high in density, absorbed waste ink can be retained. The mixture and forming method of the waste ink absorber 200 are the same as those of the first embodiment, and therefore the explanations will be omitted.

Figure 4:
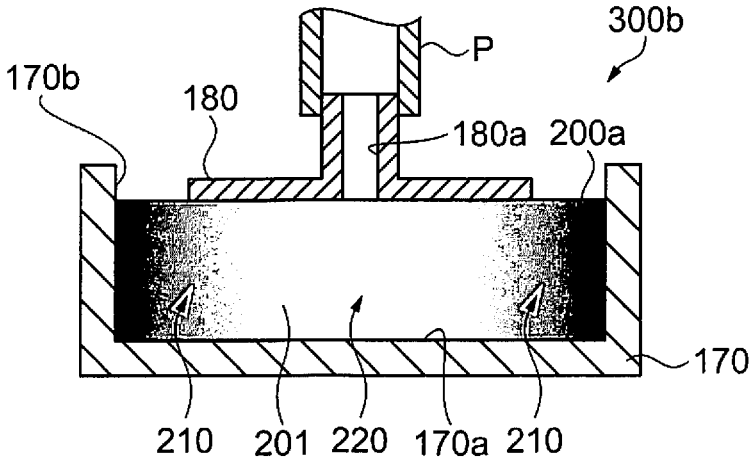
FIG. 4 is a schematic view showing a structure of a waste ink tank according to the second embodiment.

Next, the structure of the waste ink tank will be explained. FIG. 4 is a cross-sectional view showing a structure of a waste ink tank according to the second embodiment. As shown in FIG. 4, the waste ink tank 300*b* is equipped with a waste ink absorber 200*a* for absorbing waste ink and an container portion 170 for containing the waste ink absorber 200*a*.

The container portion 170 for containing the waste ink absorber 200*a* is formed into, for example, a rectangular shape by plastic material. The container portion 170 includes a bottom surface portion 170*a* and a side surface portion 170*b*, and is formed to be able to accommodate and retain the waste ink absorber 200*a*.

The structure of the waste ink absorber 200*a* is the same as the structure shown in FIG. 3, and therefore the explanation will be omitted. In this embodiment, the waste ink absorber 200*a* is arranged so that a longitudinal direction of the plain surface 201 direction becomes a horizontal direction. A lid portion 180 is provided so as to come into contact with a surface of the waste ink absorber 200*a* opposite to the surface of the waste ink absorber in contact with the bottom surface portion 170*a* of the waste ink absorber 200*a*. This lid portion 180 is arranged so as to cover the surface portion of the low density portion 220 of the waste ink absorber 200*a*. In other words, the lid portion 180 is provided so that the surface portion of the high density portion 210 of the waste ink absorber 200*a* is in an opened state.

The lid portion 180 is equipped with a hollow circular cylinder 180*a*, and a pipe P for discharging waste ink is connected to the circular cylinder 180*a*. In this case, when waste ink is discharged toward the waste ink absorbers 200*a* via the pipe P, the waste ink comes into contact with the low density portion 220 of the waste ink absorber 200*a* and impregnated into the waste ink absorber 200*a*. When the solvent of the ink is evaporated in the course of the impregnation, the viscosity of the ink increases, which deteriorates the impregnation. Therefore, the lid portion 180 is brought into contact with the low density portion 220 to control the evaporation of the ink to thereby enhance the impregnation. The absorbed waste ink is retained by the high density portion 210. Since the surface portion of the high density portion 210 is opened, it becomes possible to enhance the evaporation of the waste ink retained in the high density portion 210. For example, if the surface portion of the high density portion 210 is covered, the waste ink is not evaporated, resulting in accumulation of the waste ink. Since there is a limit in the amount of waste ink capable of being retained by the waste ink absorber 200*a*, the waste ink retainable amount can be increased by making the waste ink evaporate by opening the portion corresponding to the high density portion 210. The lid portion 180 does not compress the waste ink absorber 200*a*. It is sufficient that the lid portion 180 covers the low density portion 220, and as long as evaporation of the ink solvent can be controlled, a gap can be formed between the lid portion 180 and the waste ink absorber 200*a*.

Third Embodiment

Next, a third embodiment will be explained.

Figure 5:
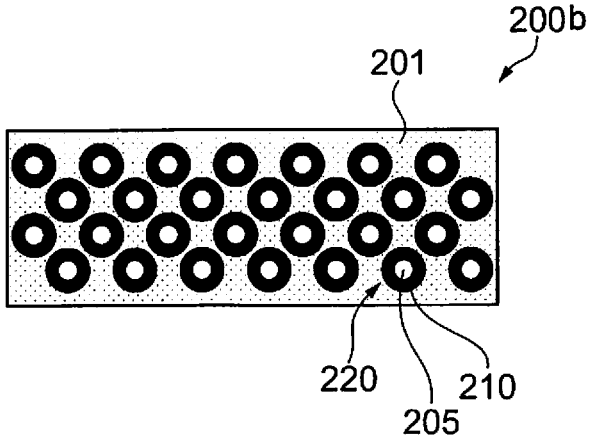
FIG. 5 is a pattern diagram showing a structure of a waste ink absorber according to a third embodiment.

First, the structure of the waste ink absorber will be explained. FIG. 5 is a pattern diagram showing the structure of the waste ink absorber according to the third embodiment. The rectangular waste ink absorber 200*b* is configured to absorb waste ink discharged from a head for ejecting ink, and is to be mounted in a waste ink tank. As shown in FIG. 5, in a single piece of a waste ink absorber 200*b* not mounted in a waste ink tank, the waste ink absorber includes, in the direction of the plain surface having the largest surface area, a gap portion 205, a high density portion 210 formed around the gap portion 205, and the low density portion 220 lower in density than the high density portion 210.

In this embodiment, a plurality of gap portions 205 evenly distributed on the entire surface of the plain surface 201 are formed. The gap portion 205 has a circular shape in a plan view. The shape is not limited to a circular shape, and can be an oval shape or a rectangular shape. Since the high density portions 210 are formed around the plurality of gap portions 205, a plurality of high density portions 210 are arranged in the low density portion 220 in a dispersed manner. Further, the volume of the high density portion 210 is formed to be smaller than the volume of the low density portion 220. Further, the total average density of the gap portion 205, the high density portion 210 and the low density portion 220 is formed to be equal to the average density of the low density portions 220.

In the waste ink absorber 200*b* formed as mentioned above, at the gap portion 205, waste ink can be easily impregnated, and at the high density portion 210, absorbed waste ink can be retained. Further, at the low density portion 220, the waste ink which could not be retained by the high density portion 210 is absorbed, which enables impregnation of the waste ink by the entire waste ink absorber 200*b*.

The waste ink absorber 200*b* is constituted by a mixture including cellulose fibers, thermoplastic resin and flame retardant. The cellulose fibers are obtained by fibrillating a pulp sheet, etc., using, for example, a dry type fibrillation machine such as a rotary crushing apparatus, etc. The thermoplastic resin contributes to bonding of the cellulose fibers, retention of an appropriate strength (hardness, etc.) of the waste ink absorber 200*b*, prevention of scattering of paper powder/fibers, and maintaining of the shape at the time of absorbing waste ink. The thermoplastic resin allows adaption of any configurations such as a fiber form or a powder form. By heating the mixture in which the cellulose fibers and the thermoplastic resin are mixed, the thermoplastic resin can be thermoplastic, welded to the cellulose fibers and are bonded each bonded. It is preferable that the welding is performed at a temperature not causing thermal deterioration of the cellulose fibers, etc. The thermoplastic resin is preferably a fibrous resin which is easily tangled with paper fibers in the fibrillated fabric. Further, it is preferable to be a composite fiber of a core-clad structure. In the thermoplastic resin of the core-in-sheath structure, the peripheral sheath portion melts at a low temperature, and the fibrous core portion is bonded to the thermoplastic resin itself or the cellulose fiber, resulting in a strong juncture.

The flame retardant is added to give flame retardant properties to the waste ink absorber 200. As flame retardant, for example, inorganic materials such as aluminum hydrate, magnesium hydrate, etc. or phosphorous organic materials (for example, such as aromatic ester phosphate such as triphenylphosphate) can be used.

As a method of forming the waste ink absorber 200*b*, for example, a mixture in which cellulose fibers, thermoplastic resin and flame retardant are mixed is screened to accumulate on a mesh belt arranged below the screen so as to form a predetermined shape to thereby form a deposited member. Then, the formed deposited member is subjected to a pressurization and heating treatment. With this, the thermoplastic resin is fused into a predetermined thickness. By subjecting it to die cutting into a desired size, a waste ink absorber 200*b* is formed.

Figure 6A:
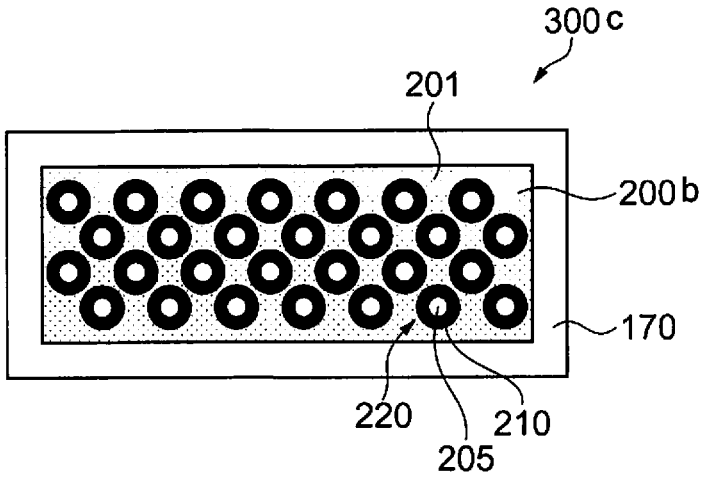
FIGS. 6A and 6B are schematic views showing a structure of a waste ink tank according to the third embodiment.
Figure 6B:
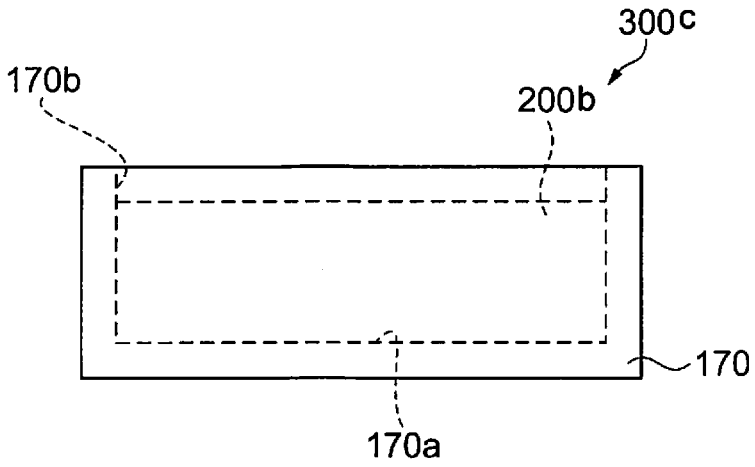

Next, the structure of the waste ink tank will be explained. FIGS. 6A and 6B show the structure of the waste ink tank. FIG. 6A is a plan view, and FIG. 6B is a side view. As shown in FIGS. 6A and 6B, the waste ink tank 300*c* is equipped with a waste ink absorber 200*b* for absorbing waste ink and an container portion 170 for containing the waste ink absorber 200*b*.

The container portion 170 for containing the waste ink absorber 200*b* is formed into, for example, a rectangular shape by plastic material. The container portion 170 includes a bottom surface portion 170*a* and a side surface portion 170*b*, and is formed to be able to accommodate and retain the waste ink absorber 200*b*.

The structure of the waste ink absorber 200*b* is the same as the structure shown in FIG. 5, and therefore the explanation will be omitted. In this embodiment, the waste ink absorber 200*b* is arranged so that the plain surface 201*a* on which the gap portions 205 are present faces toward the surface side. In this case, it is preferable that the discharge spout of the pipe for discharging waste ink is arranged at the position facing the plain surface 201.

When waste ink is discharged toward the waste ink absorbers 200*b*, the waste ink is impregnated into the inside of the waste ink absorber 200*b* via the gap portion 205 of the waste ink absorber 200. The absorbed waste ink is retained by the high density portion 210. Further, the waste ink oozed off of the high density portion 210 is impregnated in the low density portion 220 and then impregnated in the entire waste ink absorber 200*b*. Further, the waste ink impregnated in the entire waste ink absorber 200*b* is retained by the high density portion 210 formed in the entire waste ink absorber 200*b*.

Next, the structure of the liquid droplet ejecting device will be explained. The liquid droplet ejecting device is equipped with a head for ejecting ink and a waste ink tank for capturing waste ink discharged from the head. In the liquid droplet ejecting device of this embodiment, the structure equipped with the aforementioned waste ink absorber 200 (200*a*) and the waste ink tank 300 (300*a*, 300*b*, 300*c*) will be explained.

Figure 7:
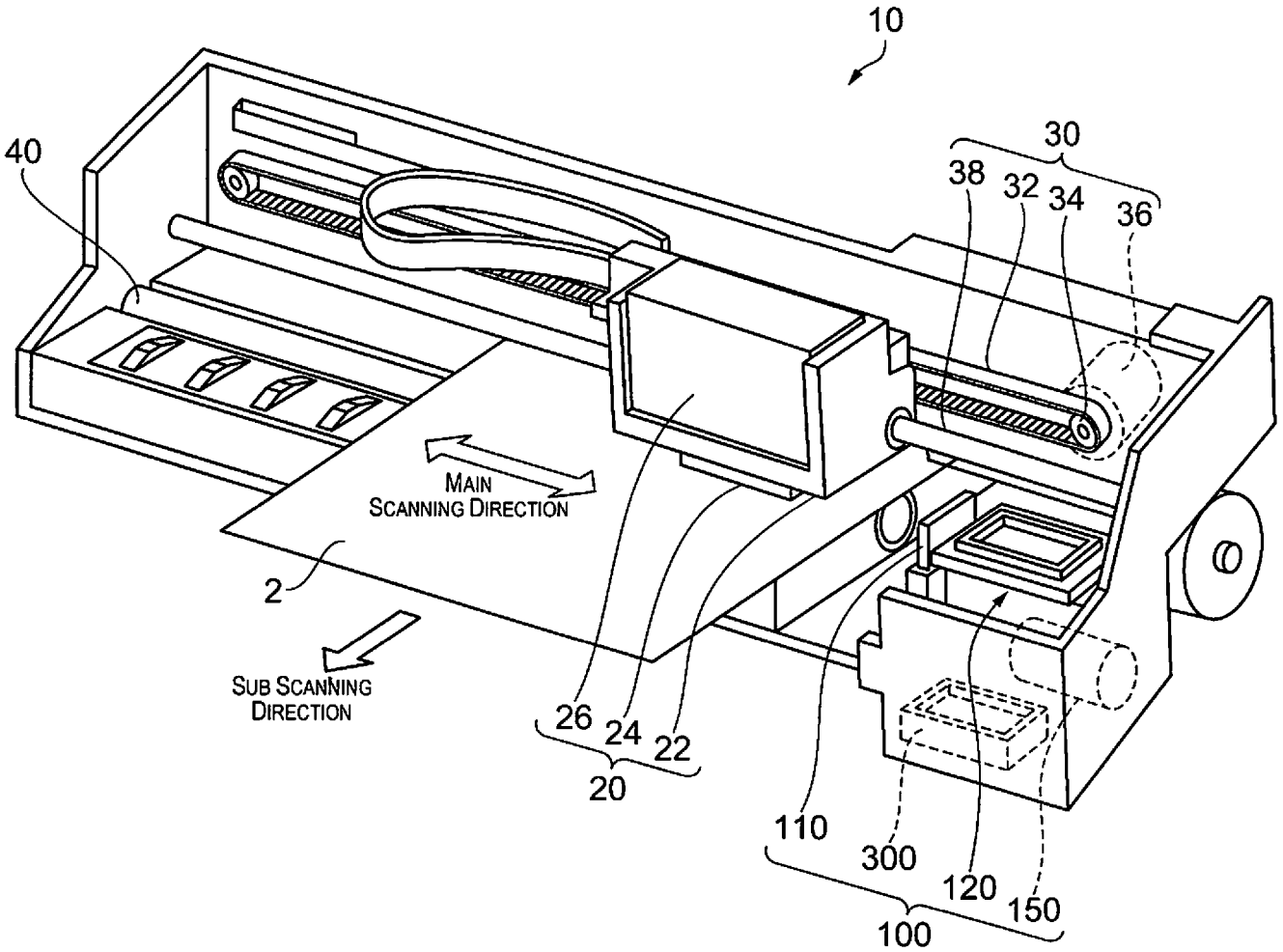
FIG. 7 is a schematic view showing a structure of a liquid droplet ejecting device.

FIG. 7 is a schematic view showing the structure of the liquid droplet ejecting device. As shown in FIG. 7, the liquid droplet ejecting device 10 is constituted by, e.g., a carriage 20 for forming ink dots on a printing medium 2 such as a printing paper while reciprocating in the main scanning direction, a drive mechanism 30 for reciprocating the carriage 20, a platen roller 40 for feeding the printing medium, a maintenance mechanism 100 for performing maintenance to enable normal printing, etc. The carriage 20 is provided with an ink cartridge 26 containing ink, a carriage case 22 for attaching the ink cartridge 26, a head 24 for ejecting ink mounted on the bottom surface side (the side facing the printing medium 2) of the carriage case 22, etc. In the head 24, a plurality of nozzles for ejecting ink are formed. The ink in the ink cartridge 26 is introduced to the head 24, and injected onto the printing medium 2 by the exact amount to thereby print an image.

The drive mechanism 30 for reciprocating the carriage 20 is constituted by the guide rail 38 extending in the main scanning direction, a timing belt 32 having a plurality of teeth on the inside, a driving pulley 34 engaged with the teeth of the timing belt 32, a step motor 36 for driving the driving pulley 34, etc. A part of the timing belt 32 is fixed to the carriage case 22, and by driving the timing belt 32, the carriage case 22 can be moved along the guide rail 38. Further, since the timing belt 32 and the driving pulley 34 are engaged with each other by the teeth, when the driving pulley 34 is driven by the step motor 36, it is possible to move the carriage case 22 depending on the driven amount with high accuracy.

The platen roller 40 for feeding the printing medium 2 is driven by non-illustrated driving motor and gear mechanism, so that the printing medium 2 can be feed by a certain amount in a sub scanning direction.

The maintenance mechanism 100 is arranged in a region called a home position located outside the printing region, and is provided with a wiper blade 110 for sweeping the surface (nozzle surface) to which an injection nozzle is formed on the bottom surface side of the head 24, a cap unit 120 for capping the head 24 by being pressed against the nozzle surface of the head 24, and a suction pump 150 for discharging ink as waste ink by being driven in a state in which the head 24 is capped with the cap unit 120. The suction pump 150 forcibly discharges ink from the head 24 to thereby recover the nozzle which became unable to inject ink due to increased viscosity, destruction of meniscuses, influence of paper powder, etc., or prevent the ink in the nozzle from being increased in viscosity. Further, below the suction pump 150, a waste ink tank 300 (300*a*, 300*b*, 300*c*) for capturing the waste ink discharged from the suction pump 150 is provided. By providing the waste ink tank 300, the outer shape of the liquid droplet ejecting device 10 increases. By improving the ink permeability and retaining properties of the waste ink absorber 200, the volume of the waste ink absorber 200 capable of retaining the same amount of ink can be reduced. With this, the size of the waste ink tank 300 and liquid droplet ejecting device 10 is reduced. The waste ink tank 300 (300*a*, 300*b*, 300*c*) has the same structure as the structure explained with reference to FIGS. 2A, 2B and 4, and therefore the explanation will be omitted. The discharged ink also includes ink by flushing that flushes ink for the purpose of viscosity increase prevention, and ink failed to reach a medium such as the ink injected outside a medium in the so-called borderless printing. Therefore, the waste ink is not limited to the ink discharged by the suction pump 150. The waste ink denotes ink which was discharged from the head 24 but not reached a medium.

According to the aforementioned embodiments, the following effects can be obtained.

(1) In the direction of the plain surface 201 having the largest surface area of the waste ink absorber 200, 200*a*, there exists a high density portion (first density portion) 210 high in density and a low density portion (second density portion) 220 low in density. With this, in the portion 220 low in density, the permeability for impregnating waste ink can be enhanced, and in the portion 210 high in density, the retention performance for retaining the impregnated waste ink can be enhanced. Accordingly, a waste ink absorber 200, 200*a* excellent in permeability and retention performance can be provided.

(2) In the aforementioned waste ink tank 300, 300*a*, 300*b*, 300*c* equipped with the waste ink absorber 200, 200*a*, 200*b*, even in cases where the waste ink tank 300, 300*a*, 300*b*, 300*c* is arranged obliquely or slightly sideways, the absorbed waste ink can be retained, and therefore the leakage thereof, etc., can be prevented.

(3) In the aforementioned liquid droplet ejecting device 10 equipped with the waste ink tank 300, 300*a*, 300*b*, 300*c*, it is possible to efficiently absorb the waste ink discharged from the head 24, prevent generation of defects such as ink leakage, etc., and secure the reliability.

(4) In the plain surface 201 having the largest surface area of the waste ink absorber 200*b*, there exists the gap portion 205, the high density portion 210, and the low density portion 220. By the gap portion 250, the waste ink can be easily impregnated. In the high density portion 210, the retention performance for retaining the impregnated waste ink can be enhanced. Further, in the low density portion 220, the waste ink oozed off of the high density portion 210 can be easily absorbed, which enables impregnation of the waste ink by the entire waste ink absorber 200*b*. Accordingly, a waste ink absorber 200*b* equipped with permeability and retention performance can be provided.

EXAMPLES

Next, concrete examples of the invention will be explained.

1. Mixture (1) Cellulose Fiber

A pulp sheet cut into a few centimeters using a cutting machine was fibrillated into a cotton-like manner with a turbo mill (made by Turbo Corporation).

(2) Thermoplastic Resin

The thermoplastic resin had a core-in-sheath structure. The sheath was polyethylene melting at 100° C. or above, and the core was a thermoplastic fiber of 1.7 dtex (Tetron, made by Teijin Ltd.) made of polyester.

(3) Flame Retardant

Aluminum hydroxide B53 (made of Nippon Light Metal Company, Ltd.)

2. Formation of Waste Ink Absorber

Example 1

Formation of Waste Ink Absorber A

Figure 8A:
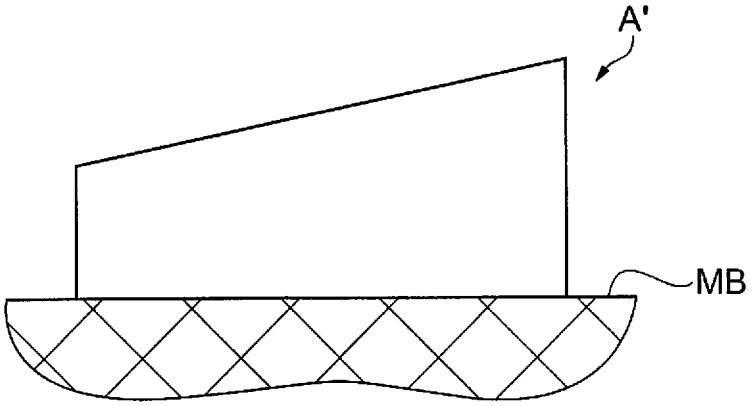
FIGS. 8A-8C are process charts showing a method of forming a waste ink absorber according to Example 1.
Figure 8B:
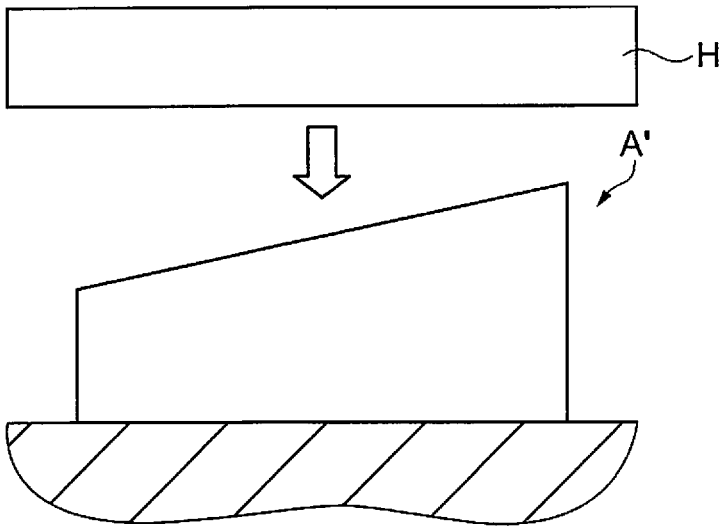
Figure 8C:
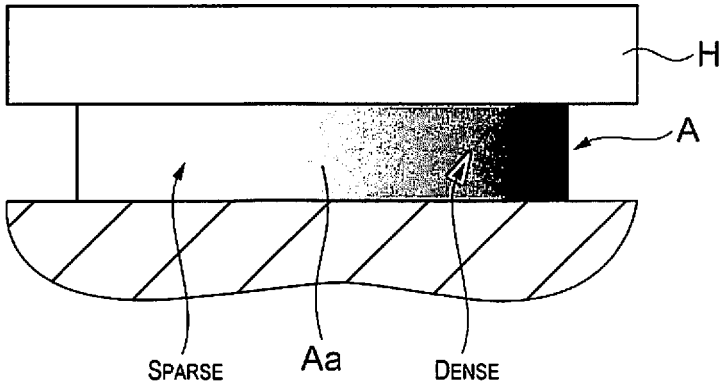

FIGS. 8A-8C are process charts showing the formation method of the waste ink absorber according to Example 1. First, as shown in FIG. 8A, a mixture C1 in which 100 weight parts of cellulose fibers, 15 weight parts of thermoplastic fibers, and 10 weight parts of flame retardant were mixed in air was screened to cause accumulation on the mesh belt MB to thereby form a deposited material A'. At this time, it was made to cause the material deposit so that the thickness differs with respect to the surface of the mesh belt MB. In this Example, the deposited material was formed such that the thickness of one end portion thereof became larger than the thickness of the other end portion. Then, the deposited material A' was subjected to a heating and pressurization treatment at 200° C. At this time, as shown in FIGS. 8B and 8C, a heated flat plate H was pressed against the deposited material A' to compress it into a predetermined thickness. In this Example, the deposited material A' was formed so that the thickest portion of the deposited material A' was compressed into ⅛ and the thinnest portion thereof was compressed into ⅕ to form a predetermined thickness (see FIG. 8A). Thereafter, the deposited material A' was cut into 150 mm×50 mm×12 mm to form a waste ink absorber A. The density of the waste ink absorber A was observed. As a result, in the direction of the flat surface Aa, a high density portion was formed at the portion corresponding to the thickest portion of the deposited material A', and a low density portion was formed at the portion corresponding to the thinnest portion. Further, in the waste ink absorber A, the density was changed from high to low toward the thinnest portion of the deposited material A' from the thickest portion. The highest density was 0.21 g/cm$^3$ and the lowest density was 0.13 g/cm$^3$.

Example 2

Formation of Waste Ink Absorber B

Figure 9A:
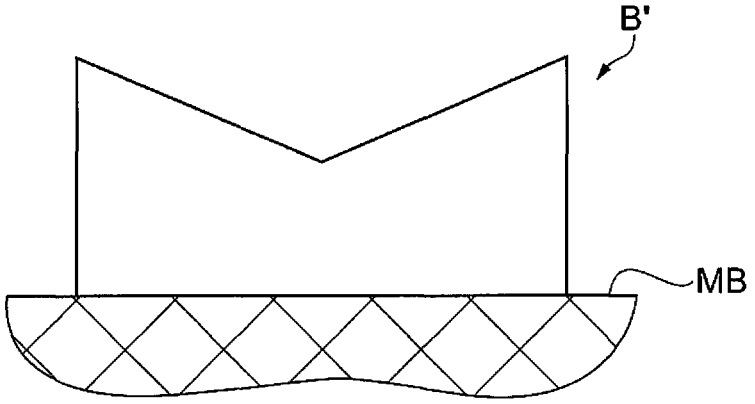
FIGS. 9A-9C are process charts showing a method of forming a waste ink absorber according to Example 2.
Figure 9B:
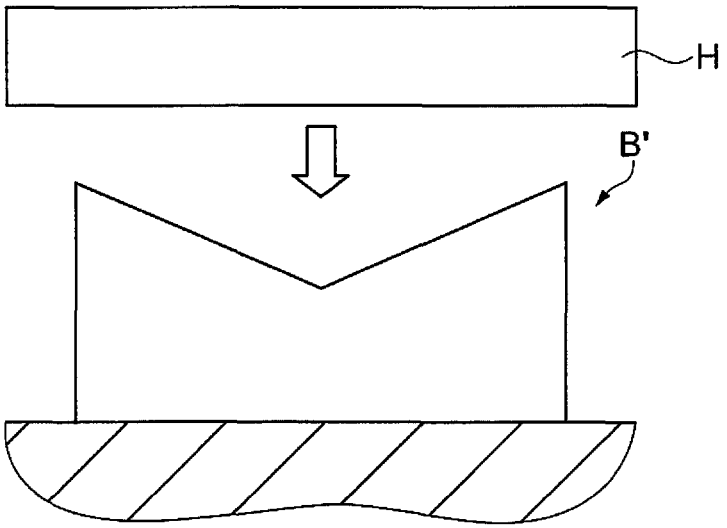
Figure 9C:
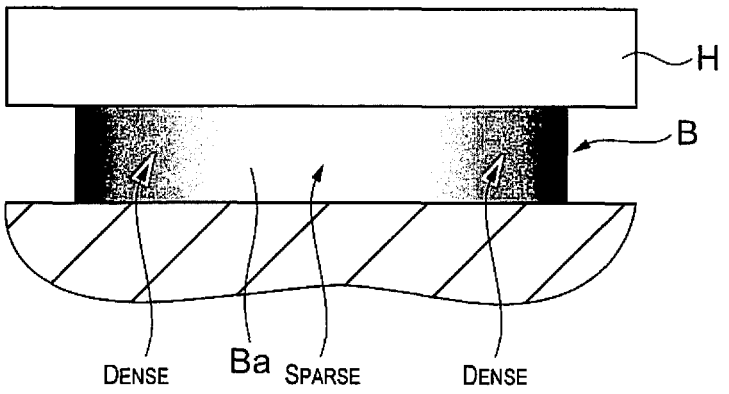

FIGS. 9A-9C are process charts showing the formation method of the waste ink absorber according to Example 2. First, as shown in FIG. 9A, a mixture C1 in which 100 weight parts of cellulose fibers, 15 weight parts of thermoplastic fibers, and 10 weight parts of flame retardant were mixed in air was screened to cause accumulation on the mesh belt MB to thereby form a deposited material B'. At this time, the material was deposited so that the thickness of the material became different with respect to the mesh belt MB surface. In this Example, a deposited material B' was formed so that the thicknesses of both end portions were larger than the thickness of the central portion. Then, the deposited material B' was subjected to a heating and pressurization treatment at 200° C. At this time, as shown in FIGS. 9B and 9C, a heated flat plate H heated to 220° C. was pressed against the deposited material B' to compress it into a predetermined thickness. In this Example, the deposited material B' was formed so that the thickest portion of the deposited material B' was compressed into ⅛ and the thinnest portion thereof was compressed into ⅕ to form a predetermined thickness (see FIG. 9A). Thereafter, the deposited material B' was cut into 150 mm×50 mm×12 mm to form a waste ink absorber B. The density of the waste ink absorber B was observed. As a result, in the direction of the flat surface Ba, a high density portion was formed at the portion corresponding to the thickest portion of the deposited material B', and a low density portion was formed at the portion corresponding to the thinnest portion. Further, in the waste ink absorber B, the density was changed from high to low toward the thinnest portion of the deposited material B' from the thickest portion. The highest density was 0.21 g/cm$^3$ and the lowest density was 0.13 g/cm$^3$.

Example 3

Formation of Waste Ink Absorber C

A mixture C1 in which 100 weight parts of cellulose fibers, 15 weight parts of thermoplastic fibers, and 10 weight parts of flame retardant were mixed in air was screened to cause accumulation on the mesh belt MB to thereby form a deposited material. Then, the formed deposit was subjected to a pressurization and heating treatment. A treatment in which a plurality of needles of a temperature which was the same as or higher than the melting temperature of the thermoplastic fiber were stuck into the formed object subjected to a pressurization and heating treatment at 200° C. was performed, and then cut into 150 mm×50 mm×12 mm to thereby form a waste ink absorber C. The density of the waste ink absorber C was observed. As a result, in the region in which the needle was stuck, the fibers and flame retardant were pushed out and a gap portion was formed. The fibers and flame retardant pushed out around the gap portion were gathered to form a high density portion (0.21 g/cm$^3$), and at the portion other than the above, a portion lower in density (0.15 g/cm$^3$) than the high density portion was formed.

Comparative Example 1

Formation of Waste Ink Absorber R

A mixture C1 in which 100 weight parts of cellulose fibers, 15 weight parts of thermoplastic fibers, and 10 weight parts of flame retardant were mixed in air was screened to cause accumulation on the mesh belt MB to thereby form a deposited material. At this time, the material was deposited so that the thickness of the material became uniform with respect to the mesh belt MB surface. Then, the deposited material was subjected to a heating and pressurization treatment at 200° C. At this time, a flat plate H heated to 220° C. was pressed against the deposited material to compress it into a predetermined thickness. Thereafter, it was cut into 150 mm×50 mm×12 mm to form a waste ink absorber R. The density of the waste ink absorber R was observed. As a result, in a direction along the flat surface, the density was uniform, 0.15 g/cm$^3$.

3. Evaluation

Next, for the aforementioned Example 1, Example 2, Example 3, and Comparative Example 1, evaluation of the ink permeability, ink retaining property and ink deposition property is performed. Each evaluation method is as follows.

(a) Evaluation Method of Ink Permeability and Ink Retaining Property

Figure 10A:
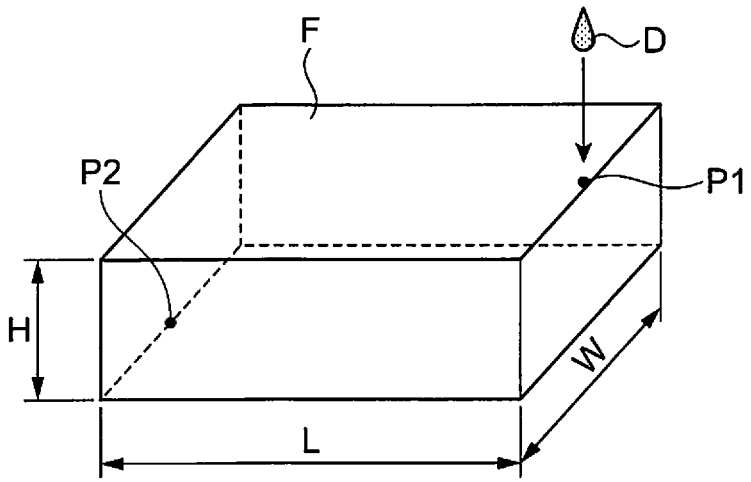
FIGS. 10A and 10B are views showing a method of evaluating ink permeability and retention performance of a waste ink absorber.
Figure 10B:
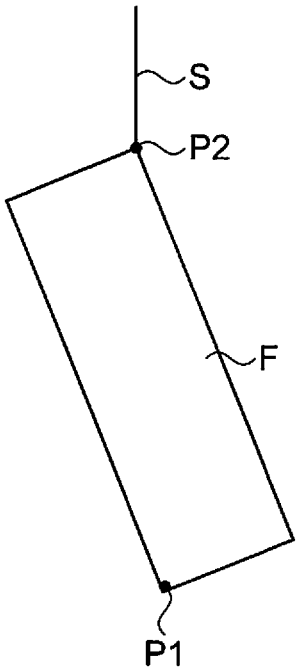

FIGS. 10A and 10B are schematic drawings showing an evaluation method of the ink permeability and ink retaining property of the waste ink absorber. As shown in FIG. 10A, an ink absorbing member F of 150 mm (L)×50 mm (W)×12 mm (H) is placed on a flat surface, and ink of 80 ml is slowly poured in from the first point P1 on the upper surface. In Example 1, ink is poured in from the low density portion of one end portion of the waste ink absorber A. In Example 2, ink is poured in from the low density portion of one end central portion of the waste ink absorber B. In Example 3, ink is poured in from the surface in which the gap portion is formed. If the ink does not permeate the absorbing member F, it is left for 5 minutes, and then pouring is continued. In cases where the ink does not permeate even if it is left for 5 minutes, it is assumed that ink does not permeate, and the judgment of the ink permeability is NG. On the other hand, in cases where all ink permeates, the judgment of the ink permeability is OK. When all ink was poured in, it is left for 5 minute, and then as shown in FIG. 10B, the member is hanged from the second point P2 using a strap, etc., so that the first point P1 from which the ink was poured is arranged downward. In this hanging state, the impregnated ink gathers at one end portion of the ink absorbing member F and becomes hard to be retained. When the ink drips off from the ink absorbing member F, it is assumed that ink cannot be retained, and therefore the judgment of the ink retaining property becomes NG. On the other hand, when the ink does not drip off, the judgment of the ink retaining property becomes OK. With this evaluation, it is understood that no ink will leak even if the liquid droplet ejecting device or the waste ink tank is inclined.

(b) Evaluation Method of Ink Deposition Property

An ink absorber F of 150 mm (L)×50 mm (W)×12 mm (H) is placed on a flat surface, and under the circumstance of 20% RH at 40° C., ink is dropped by 0.4 g at a time every hour on a central portion on the upper surface of the placed absorber F. After passing 240 hours, if the thickness of the solid deposited material on the surface of the ink absorber F is less than 1 mm, the judgment of the ink deposition property is OK. On the other hand, if the thickness of the deposited material is 1 mm or more, the judgment of the ink deposition property is NG.

In the aforementioned Examples and Comparative Example, the ink permeability, the ink retaining property and the ink deposition property were evaluated. The evaluation results are shown in Table 1.

TABLE 1

| | Ink permeability | Ink retaining property | Ink deposition property |
|---|---|---|---|
| Example 1 | OK | OK | OK |
| Example 2 | OK | OK | OK |
| Example 3 | OK | OK | OK |
| Comparative Example 1 | OK | NG | OK |

As shown in Table 1, according to the waste ink absorbers A, B, C (Example 1, 2, 3) according to the invention, all of evaluations on the ink permeability, the ink retaining performance, and the ink deposition property were excellent. On the other hand, in Comparative Example 1, no satisfactory result could be obtained in terms of the ink retaining property. In Comparative Example 1, since the density in Example 1, 2, and 3 was low as compared to the high density portion and even, ink does not permeate and is not deposited, but a large amount of ink cannot be retained. In Example 1, 2, and 3, since there exist a low density portion and a high density portion, both of the ink permeability at the low density portion and the ink retaining property at the high density portion are satisfied. Further, since the ink is absorbed from the low density portion, the ink can be promptly impregnated, and no deposited material remains.

In some cases, the high density portion and the low density portion which are features of this application can be recognized by the appearance by eye. However, in some cases, if the high density portion and the low density portion are slightly different from each other, the difference cannot be recognized by eye. As a method of verification on that case, when ink is dropped on portions different in a direction along a flat surface, if the easiness of permeability is different, it can be said that the density differs. In cases where the entire waste ink absorber is uniform in density, ink permeates approximately evenly regardless of the dropping portion.

The aforementioned Examples are employed as a waste ink tank 300 (300*a*, 300*b*, 300*c*) and a waste ink tank 200, 200*a*, 200*b* for use in a liquid droplet ejecting device 10. Here, ink includes various kinds of liquid compositions, such as, common aqueous ink, oil ink, pigment ink, dye ink, solvent ink, resin ink, sublimation transfer ink, gel ink, hot melt ink, ultraviolet cure ink, etc. Further, ink can be any materials that a head 24 can inject. For example, it is enough that the material is in a liquid phase state, and ink includes not only liquid crystal, a liquid state material high or low in viscosity, sol, gel liquid, fluid material such as inorganic solvent, organic solvent, solution, liquid resin, liquid metal (metal thermoplastic solution), liquid as one condition of a material, but also a material in which functional material particles of solid materials such as pigments or metal particles are dissolved, dispersed or mixed in a solvent, etching liquid, lubricating oil. Further, the liquid droplet ejecting device can be, other than an ink jet printer, a device for ejecting ink including electrode materials or materials such as coloring materials used to produce, for example, a liquid crystal display, an EL (electroluminescence) display, a surface emitting display, or a color filter in a dispersed or dissolved manner, a device for ejecting a bio organic substance for use in a bio chip production, a device for ejecting ink as a sample used as a precision pipette, a printing device or a micro dispenser. Furthermore, a device for ejecting lubricating oil to a precision machine such as a clock, a camera, etc., at a pin point, a device for forming, e.g., a small rounded lens (optical lens) for use as an optical communication element, a device for ejecting ultraviolet curable liquid and hardening it by light or heat, or a device for ejecting etching liquid such as acid, alkali, etc., to etch a substrate, etc., can be employed. The invention can be applied to any one of liquid droplet ejecting device among these devices.

In the aforementioned Examples, in order to prevent fluffing of the surface of a waste ink absorber 200, 200*a*, 200*b*, a thin nonwoven fabric can be adhered to the surface. Since the nonwoven fabric to be adhered is thin as compared with the waste ink absorber 200, 200*a*, 200*b*, the influence to the ink permeability or retaining performance is small. In the aforementioned Examples, the waste ink absorber is formed into a rectangular shape, but not limited to it. A rectangular shape can partially have a cutting and/or dent, and the shape can be non-rectangular and include an arc portion and/or an inclined portion. In the drawings of the aforementioned Example, the percentage of the low density portion and the high density portion was depicted approximately the same. This can be changed depending on the ink. For example, if ink is large in viscosity and hard to impregnate, it is preferable that the percentage of the low density portion is increased than the percentage of the high density portion to enhance the permeability. To the contrary, if the viscosity is small and it is easy to be impregnated, it is preferable that the percentage of the low density portion is decreased as compared to the high density portion. Further, the low density portion and the high density portion can be in a changeable state, or the density is gradually increased from the low density portion to the high density portion. Although the density was described in each Example and Comparative Example, these are samples. In the drawing of the aforementioned Example 3, it is depicted such that all of the gap portions 205 are constant in size, but the size can be different with each other, In the aforementioned Examples, the pulp sheet includes a wood pulp of aconifer, a broad-leaf tree, etc., non-wood plant fibers such as hemp, cotton, kenaf, etc. In the aforementioned Examples, cellulose fibers are mainly used, but it is not limited to cellulose fibers as long as it is a material which can absorb ink and differentiate the density. The fiber can be a fiber made from plastic such as polyurethane or polyethylene terephthalate (PET) or another fiber such as wool. The method of forming the waste ink absorber is not limited to the method recited in the aforementioned Examples. As long as the features of the present application can be exerted, another production method such as a wet type method can be employed.

What is claimed is:

1. A waste ink absorber to be mounted in a waste ink tank to absorb waste ink discharged from a head for ejecting ink, wherein, in an uncompressed state of a single piece of the waste ink absorber not mounted in the waste ink tank, the waste ink absorber includes a first density portion and a second density portion in a direction along a plane surface having a largest surface area, wherein the second density portion is higher in density than the first density portion, the first density portion and the second density portion are formed in the plane surface having the largest surface area, and the density of the single piece of the waste ink absorber is changed from high to low in the direction along the plane surface having the largest surface area.

2. The waste ink absorber according to claim 1, wherein, in a state in which the waste ink absorber is not mounted in the waste ink tank, a viscosity of the waste ink absorber is constant.

3. The waste ink absorber according to claim 1, wherein the waste ink absorber has the second density portion around a void and the first density portion around the second density portion.

4. The waste ink absorber according to claim 3, wherein a volume of the second density portion is smaller than a volume of the first density portion.

5. The waste ink absorber according to claim 3, wherein a total average density of the void, the second density portion and the first density portion is the same as the first density portion.

6. A waste ink tank comprising:

the waste ink absorber according to claim 1; and a container portion for containing the waste ink absorber.

7. A liquid droplet ejecting device comprising:

a head for injecting ink; and the waste ink tank according to claim 6 for capturing the waste ink discharged from the head.

8. The waste ink absorber according to claim 1, wherein, in a state in which the waste ink absorber is not mounted in the waste ink tank, a thickness of the waste ink absorber is constant.

* * * * *